US006280239B1

(12) United States Patent
Cheng

(10) Patent No.: US 6,280,239 B1
(45) Date of Patent: Aug. 28, 2001

(54) ELECTRIC CONNECTOR

(75) Inventor: Chun-Te Cheng, Taoyuan Hsein (TW)

(73) Assignee: Aces Electronic Co., Ltd., Taoyuan Hsien (TW)

( * ) Notice: Subject to any disclaimer, the term of this patent is extended or adjusted under 35 U.S.C. 154(b) by 0 days.

(21) Appl. No.: 09/690,725

(22) Filed: Oct. 18, 2000

(51) Int. Cl.[7] ..... H01R 12/28

(52) U.S. Cl. ..... 439/495

(58) Field of Search ..... 439/495, 499, 439/496, 67, 77, 260

(56) References Cited

U.S. PATENT DOCUMENTS 4,747,787 * 5/1988 Siwinski ..... 439/108
5,906,504 * 5/1999 Igarashi et al. ..... 439/495
6,210,209 * 4/2001 Wu et al. ..... 439/495

* cited by examiner

*Primary Examiner*—Paula Bradley
*Assistant Examiner*—Briggitte R. Hammond
(74) *Attorney, Agent, or Firm*—Dougherty & Troxell

(57) ABSTRACT

An electric connector includes a female connector holding two sets of terminals connected to a circuit substrate, and a male connector holding a ribbon cable and a set of terminals for connection to the terminals of the female connector, the female connector having a middle hollow and a protruding locating frame disposed in the hollow, the terminals of the female connector each having a contact portion inserted into the hollow and suspended in the protruding locating frame at one side for contacting one terminal of the male connector, the male connector having a bottom hole adapted to receive the protruding locating frame of the female connector, the terminals of the male connector each having inverted U-shaped bottom contact portion suspended in the bottom hole of the male connector and adapted to contact the terminals of the female connector, and a U-shaped top retaining portion electrically connected to the ribbon cable.

1 Claim, 6 Drawing Sheets

ELECTRIC CONNECTOR

BACKGROUND OF THE INVENTION

The present invention relates to an electric connector comprised of a female connector mounted on a circuit substrate and a female connector fastened to a ribbon cable and adapted for connection to the female connector, and more particularly to such an electric connector, which is easy to assemble and maintain.

FIGS. 1 and 2 show an electric connector according to the prior art. This structure of electric connector comprises a housing 1' defining an insertion slot 11', two sets of terminals 2' mounted in the housing 1' at two sides of the insertion slot 11', and a holding down device 3' plugged into the insertion slot 11' to secure a ribbon cable 4' to the terminals 2'. The terminals 2' each have a top contact portion 21' disposed at one side of the insertion slot 11', and a rear mounting portion 22' extended out of the housing 1 and welded to a respective contact at a circuit substrate 5'. The holding down device 3' comprises a plug portion 31' plugged into the insertion slot 11' of the housing 1' to hold down the ribbon cable 4', keeping conductors of the ribbon cable 4' in contact with the top contact portion 21' of each terminal 2'. This structure of electric connector is still not satisfactory in function. For maintenance's sake, the ribbon cable 4' may have to be disconnected from the housing 1'. Frequency mounting and dismounting the ribbon cable causes the conductors of the ribbon cable 4' to wear quickly, and the conductors of the ribbon cable 4' tend to be broken during mounting or dismounting of the ribbon cable 4'.

SUMMARY OF THE INVENTION

The invention has been accomplished to provide an electric connector, which eliminates the aforesaid drawbacks. According to one aspect of the present invention, the electric connector comprises a female connector mounted on a circuit substrate, the female connector holding two sets of terminals connected to respective contact at the circuit substrate, and a male connector connected to a ribbon cable and adapted for connecting to the female connector, the male connector holding a set of terminals, which are maintained in contact with respective conductors of the ribbon cable. The terminals of the male connector are respectively forced into contact with the terminals of the female connector after the male connector had been fastened to the female connector. According to another aspect of the present invention, the female connector comprises a middle hollow adapted to receive the male connector and a protruding locating frame adapted to hold a front contact portion of each terminal of the female connector, and the male connector has a bottom hole adapted to receive the protruding locating frame of the female connector, enabling the terminals of the male connector to be respectively forced into contact with the front contact portion of each terminal of the female connector.

DETAILED DESCRIPTION OF THE PREFERRED EMBODIMENT

Figure 1:
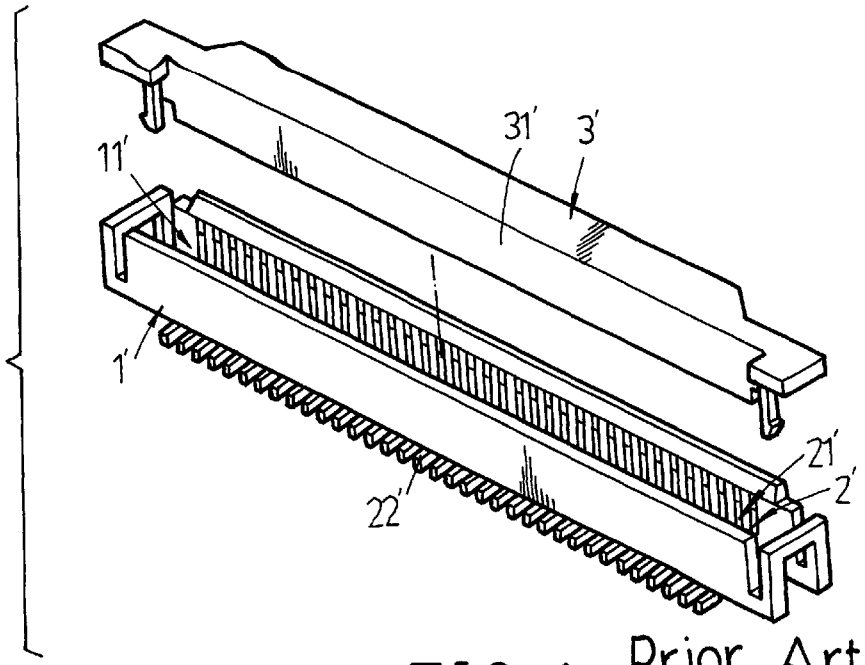
FIG.1 Prior Art
FIG. 1 is an exploded view of an electric connector according to the prior art.
Figure 2:
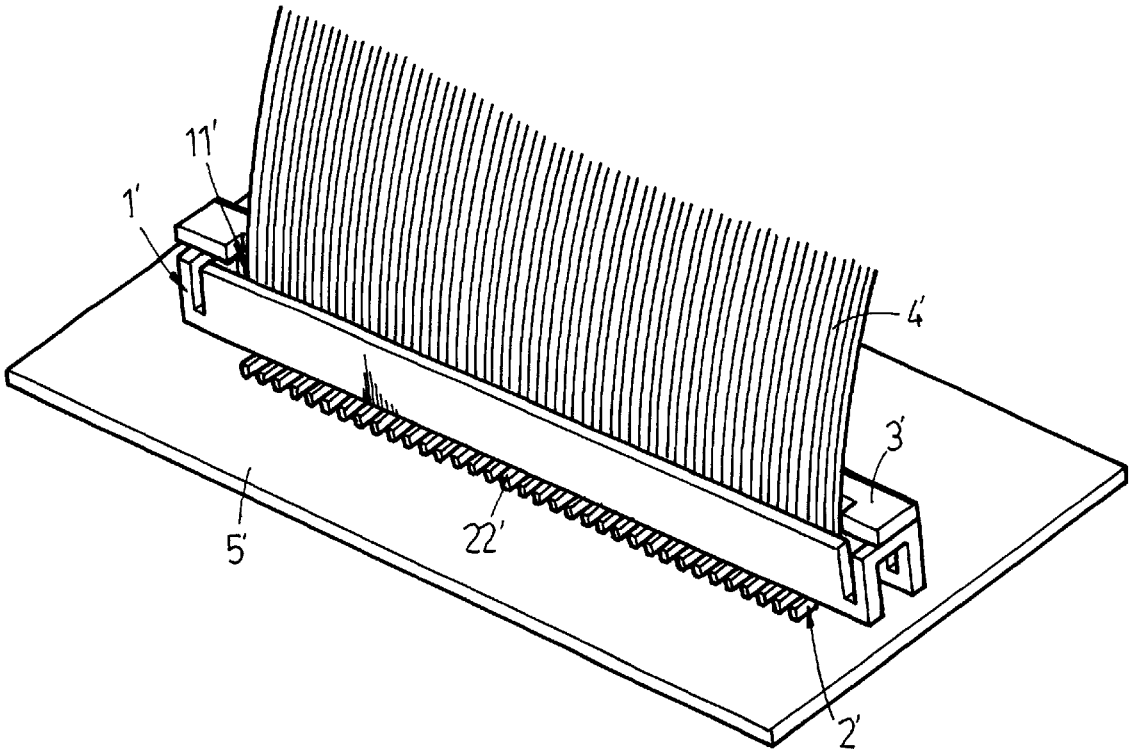
FIG.2 Prior Art
FIG. 2 is an installed view of the prior art electric connector.
Figure 3:
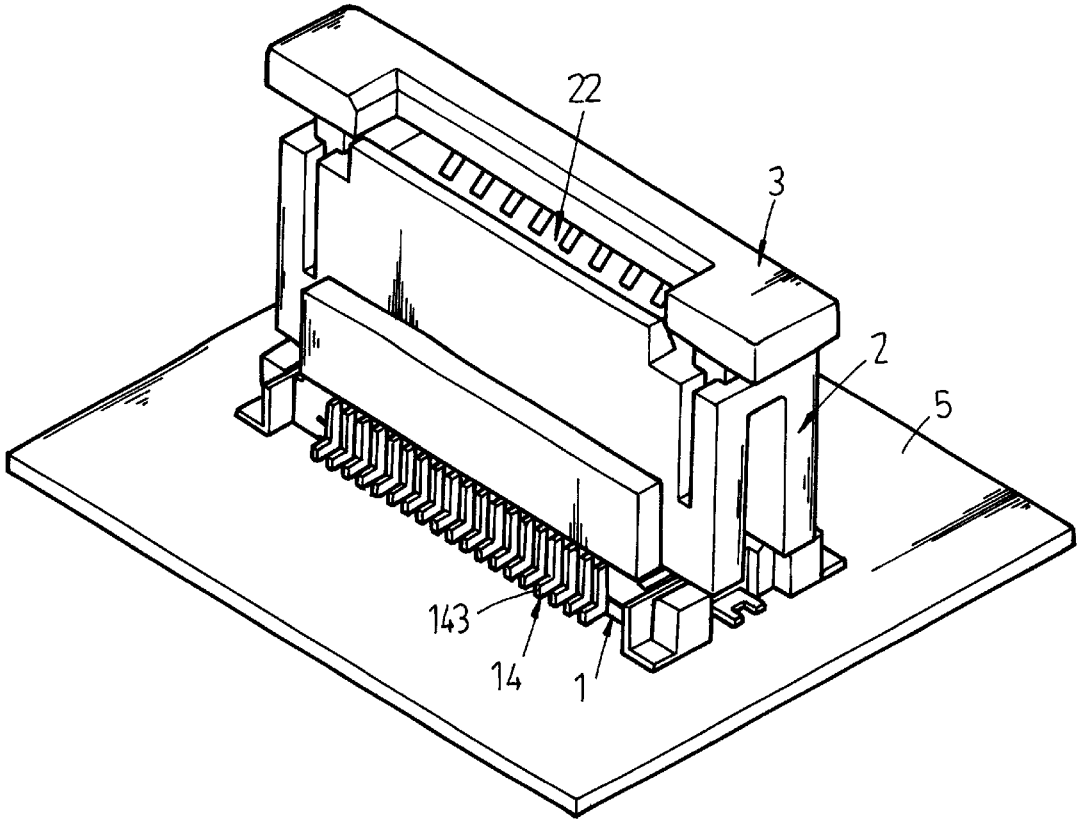
FIG. 3 is a perspective view of an electric connector installed in a circuit substrate according to the present invention (the ribbon cable excluded).
Figure 4:
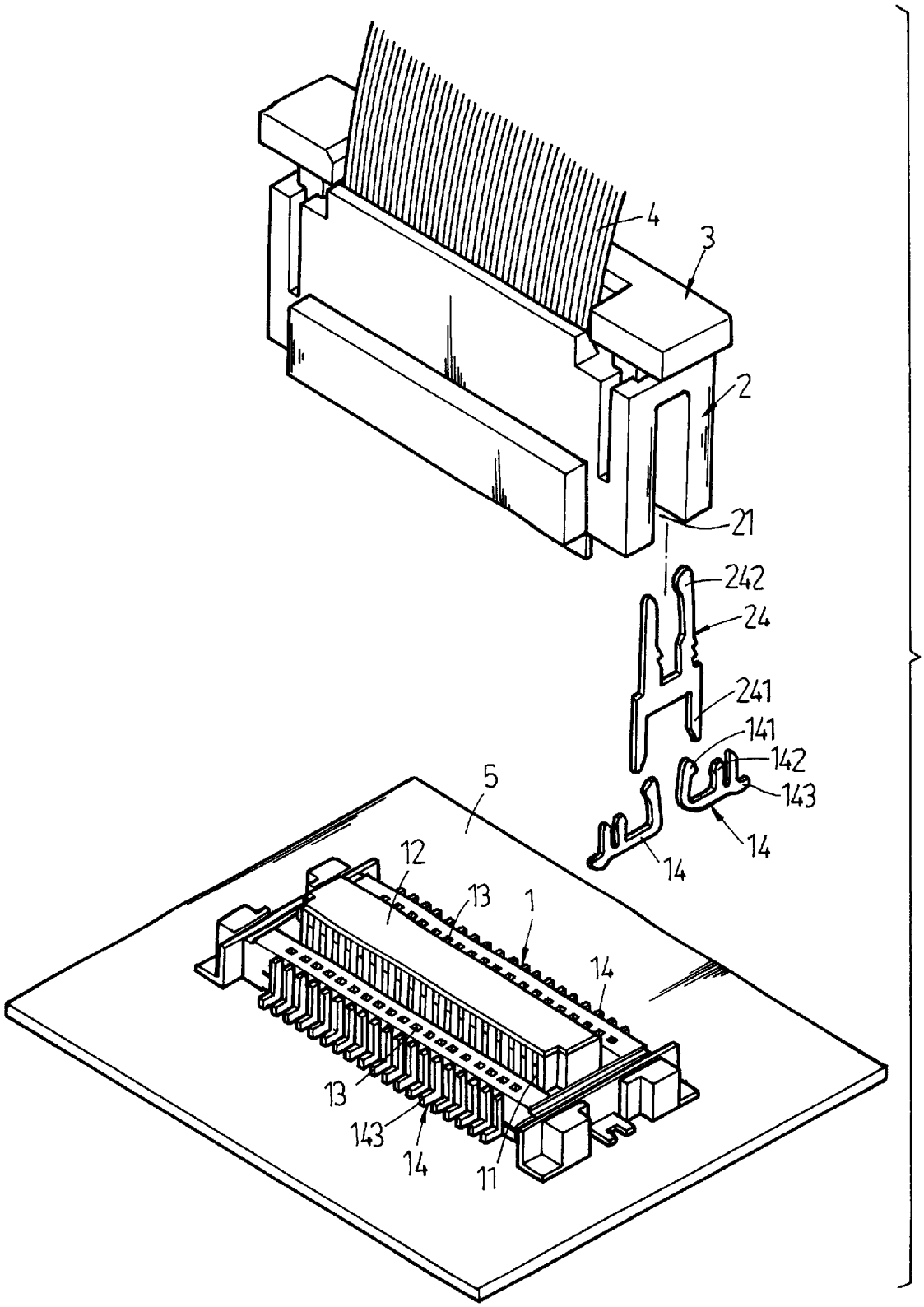
FIG. 4 is an exploded view of the electric connector according to the present invention.

Referring to FIGS. from 3 through 7, an electric connector in accordance with the present invention is generally comprised of a female connector 1 and a male connector 2. The female connector 1 comprises a narrow, elongated hollow 11 in the middle, a protruding locating frame 12 disposed in the hollow 11, two longitudinal rows of locating holes 13 disposed along two opposite lateral sides of the hollow 11, and two sets of terminals 14 respectively bilaterally disposed at the bottom side. The terminals 14 each have a front contact portion 141 inserted into the hollow 11 and suspended in the protruding locating frame 12 at one side, a rear mounting portion 143 extended out of one lateral side of the body of the female connector 1 and adapted for welding to a circuit substrate 5, and a middle positioning portion 142 engaged into one locating hole 13.

The male connector 2 comprises a bottom hole 21 corresponding to the protruding locating frame 12, an elongated top slot 22 disposed in communication with the bottom hole 21, two positioning grooves 23 disposed in the top slot 22 at two opposite sides, a set of terminals 24 mounted in the bottom hole 21 corresponding to the terminals 14 of the female connector 1, a ribbon cable 4 inserted into the elongated top slot 22 and electrically connected to the terminals 24, and a holding down plug 3 mounted in the top slot 22 to hold down the ribbon cable 4. The terminals 24 each comprises a inverted U-shaped bottom contact portion 241 suspended in the bottom hole 21 and adapted to contact a respective terminal of each set of the two sets of terminals 14 of the female connector 1, and a U-shaped top retaining portion 242 suspended in the top slot 22. The holding down plug 3 comprises a bottom plug portion 31 engaged into the U-shaped top retaining portion 242, and two retaining portions 33 protruded from two opposite sidewalls 32 thereof and respectively engaged into the positioning grooves 23 in the top slot 22.

Figure 5:
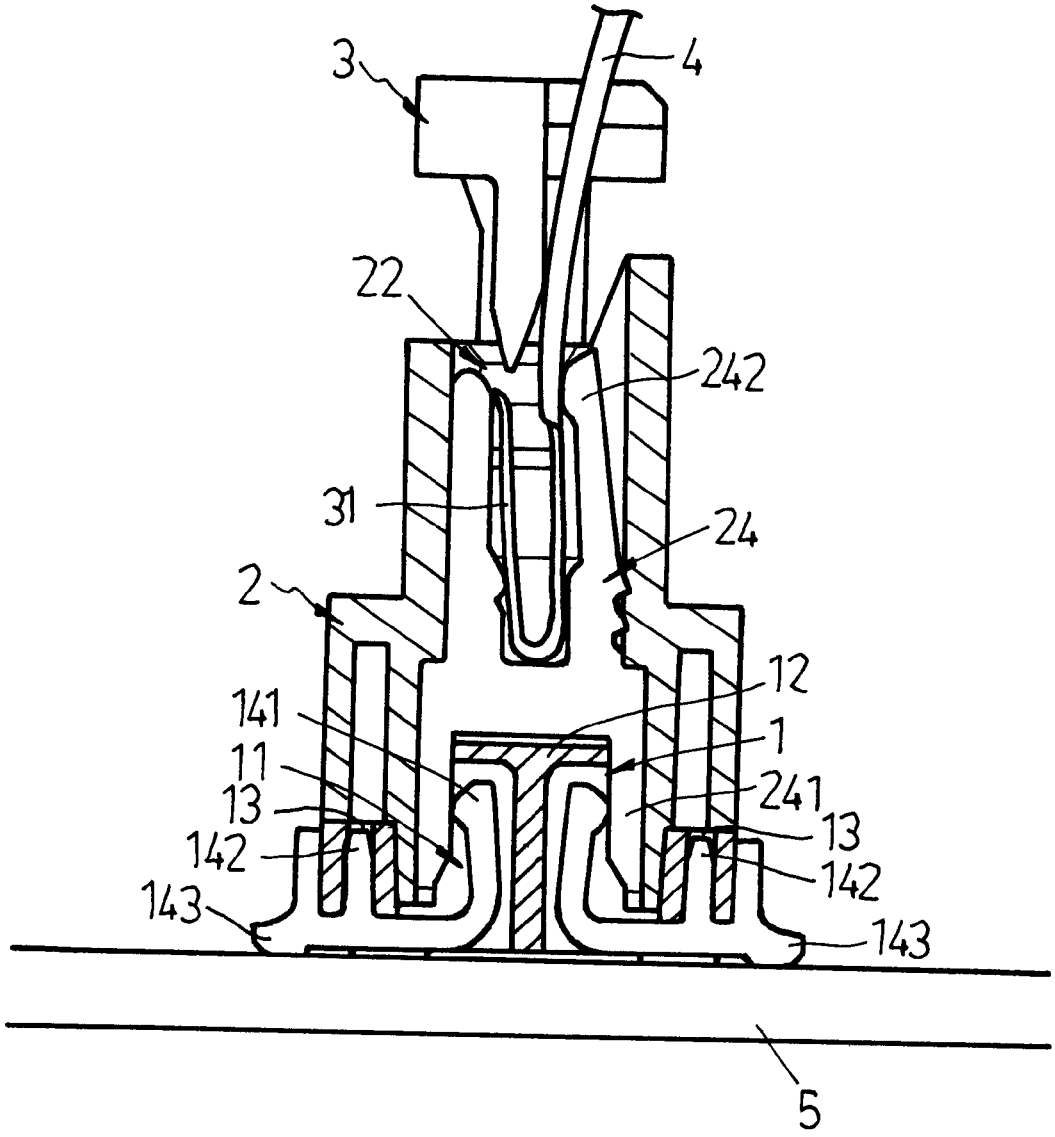
FIG. 5 is a sectional assembly view of the present invention.
Figure 6:
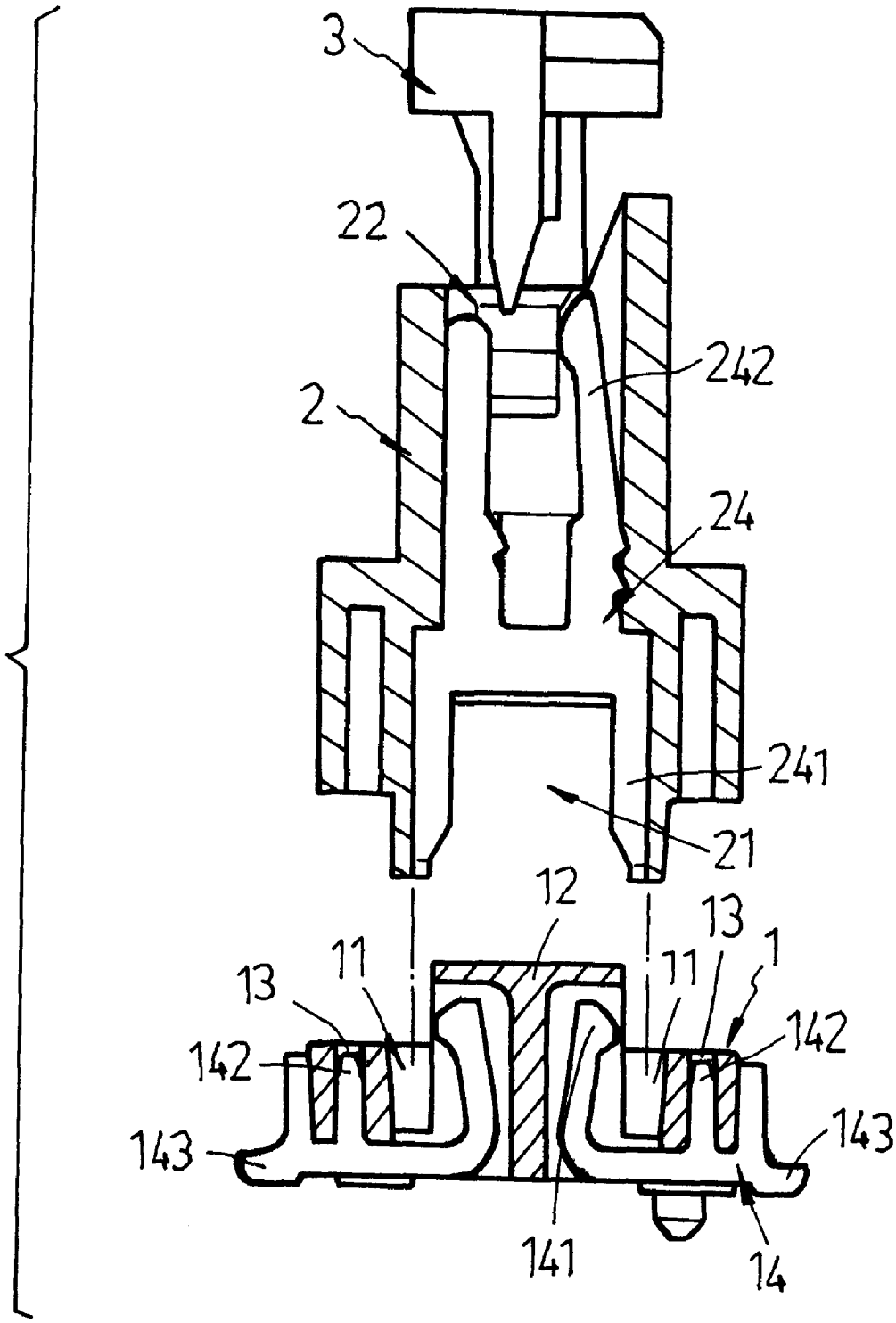
FIG. 6 is a sectional view of the present invention before the installation of the ribbon cable.
Figure 7:
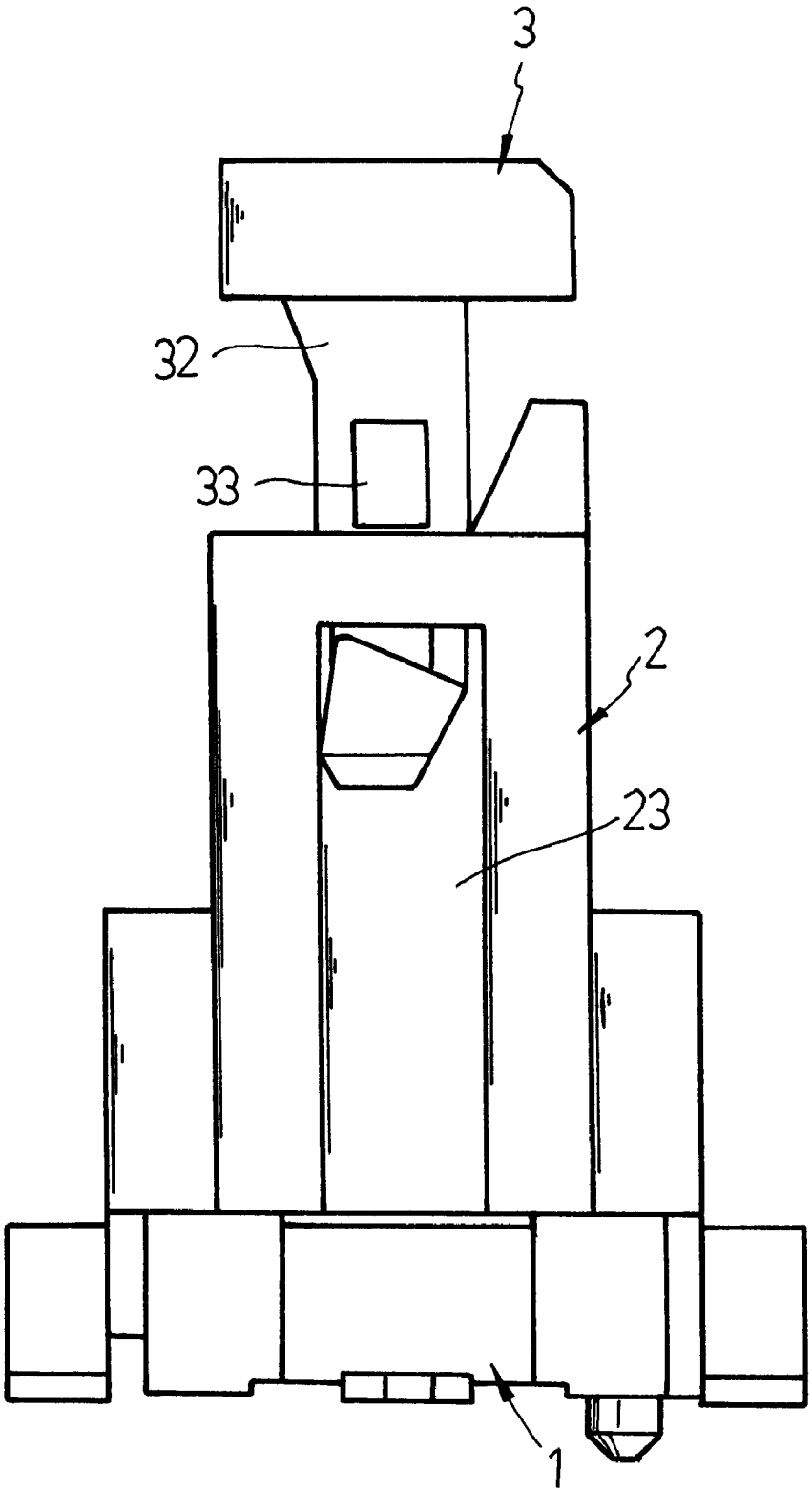
FIG. 7 is a side plain view showing the male connector fastened to the female connector according to the present invention.

Referring to FIGS. 5 and 6 again, the rear mounting portion 143 of each terminal 14 of the female connector 1 are welded to a respective contact at the circuit substrate 5, and the holding down plug 3 is plugged into the top slot 22 to hold down the ribbon cable 4. After connection of the male connector 2 to the female connector 1, the protruding locating frame 12 of the female connector 1 is received in the bottom hole 21 of the male connector 2, and the inverted U-shaped bottom contact portion 241 of each terminal 24 of the male connector 2 is respectively retained in contact with the front contact portion 141 of the terminals 14 of the female connector 1. Because the female connector 2 is directly fastened to the ribbon cable 4 and the male connector 1 is fixedly mounted on the circuit substrate 5 with the terminals 14 welded to respective contacts at the circuit substrate 5, the ribbon cable 4 is positively accurately connected to the contacts at the circuit substrate 5 after connection of the male connector 2 to the female connector 1.

While only one embodiment of the present invention has been shown and described, it will be understood that various modifications and changes could be made thereunto without departing from the spirit and scope of the invention disclosed.

What the invention claimed is:

1. An electric connector comprising a female connector mounted on a circuit substrate, said female connector comprising two sets of terminals disposed at two opposite lateral sides and respectively welded to respective contact on said circuit substrate, and a male connector adapted for connection to said female connector, said male connector comprising a set of terminals adapted to contact the terminals of said female connector, an elongated top slot, and a ribbon cable inserted into said elongated top slot and electrically connected to the terminals of said male connector, wherein:

said female connector comprises a narrow, elongated hollow disposed in the middle, and a protruding locating frame disposed in said hollow;

the terminals of said female connector each have a contact portion inserted into said elongated hollow of said female connector and suspended in said protruding locating frame at one side for contacting one terminal of said male connector;

said male connector comprises a bottom hole adapted to receive the protruding locating frame of said female connector;

the terminals of said male connector each comprise inverted U-shaped bottom contact portion suspended in the bottom hole of said male connector and adapted to contact the terminals of said female connector, and a U-shaped top retaining portion suspended in the top slot of said male connector and electrically connected to said ribbon cable.

* * * * *